United States Patent [19]

Gould

[11] 4,423,568

[45] Jan. 3, 1984

[54] SPLASH SHIELD AND CUTTINGS GUARD FOR GLASS ROUTER

[76] Inventor: Larry L. Gould, 516 S. Calumet, Aurora, Ill. 60506

[21] Appl. No.: 308,395

[22] Filed: Oct. 5, 1981

[51] Int. Cl.[3] ..... B24B 55/00

[52] U.S. Cl. ..... 51/72 R; 51/267; 51/270; 51/272; 144/251 A

[58] Field of Search ..... 51/72 R, 131.3, 267, 51/268, 269, 270, 272, 283 R, 283 E; 144/251 R, 251 A, 252 R, 252 A; 409/134

[56] References Cited

U.S. PATENT DOCUMENTS

| | | | |
|---|---|---|---|
| 665,380 | 1/1901 | Barnes | 51/267 |
| 1,582,481 | 4/1926 | Law | 51/131.3 X |
| 2,080,880 | 5/1937 | Schenk | 51/131.3 |
| 2,110,441 | 3/1938 | Kasch | 51/267 |
| 2,579,337 | 12/1951 | Reaser et al. | 51/283 E X |
| 3,183,629 | 5/1965 | Ver Meulen | 51/272 X |

FOREIGN PATENT DOCUMENTS

| | | | |
|---|---|---|---|
| 1179116 | 5/1959 | France | 51/272 |

*Primary Examiner*—Robert C. Watson
*Assistant Examiner*—Robert P. Olszewski
*Attorney, Agent, or Firm*—McCaleb, Lucas & Brugman

[57] ABSTRACT

A splash shield and cuttings guard for a glass router comprises a side shield and an eye shield formed of transparent plastic sheet material. The side shield consists of a C-shaped horizontal base plate with an upstanding wall about the outer margin and a depending flange about the inner margin, the flange fitting over the rim of a glass router housing about the back and sides of a work table above a liquid coolant reservoir. Liquid flung outwardly by the router grinding wheel is intercepted by the wall and returned via the base plate and the depending flange to the reservoir for reuse. The eye shield consists of an upstanding section in front of the housing, a diagonal section at the top thereof extending rearwardly over the router work table, and a rearwardly extending lower flange with openings engaging feet on the bottom of the router housing.

5 Claims, 9 Drawing Figures

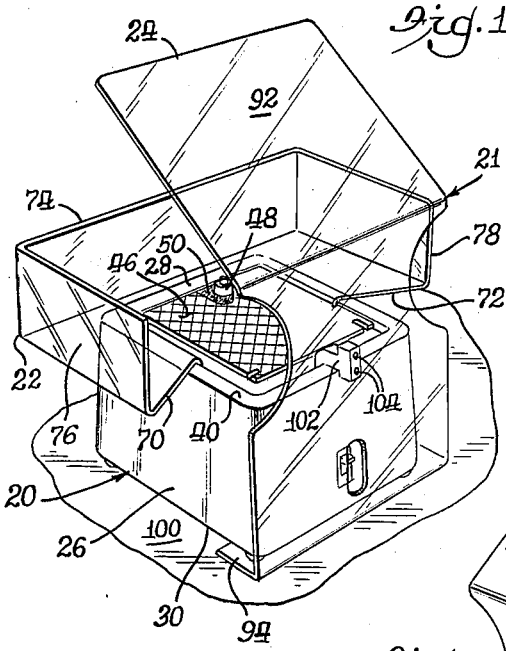
Fig. 1.
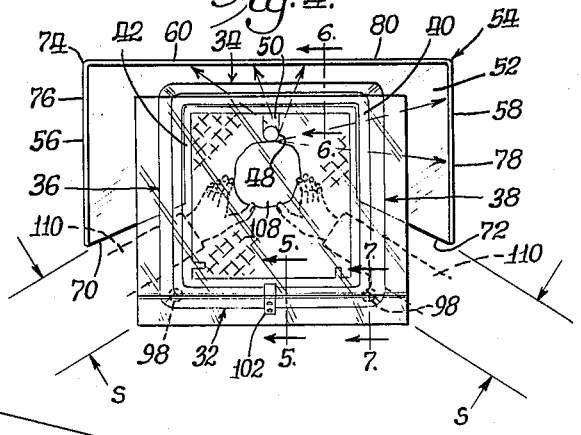
Fig. Д.
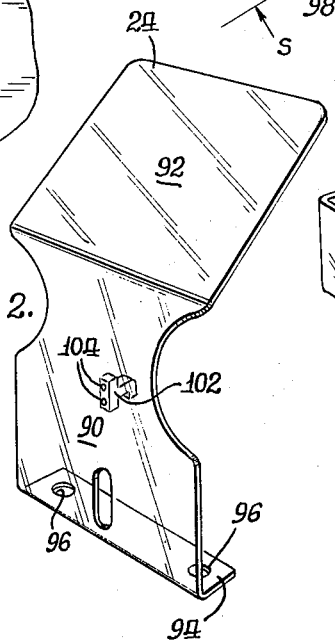
Fig. 2.
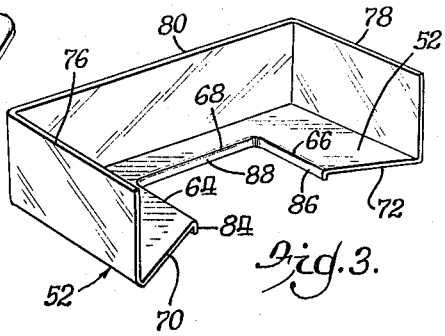
Fig. 3.
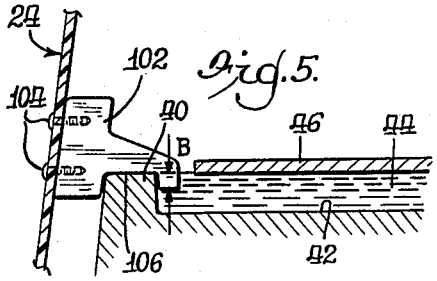
Fig. 5.
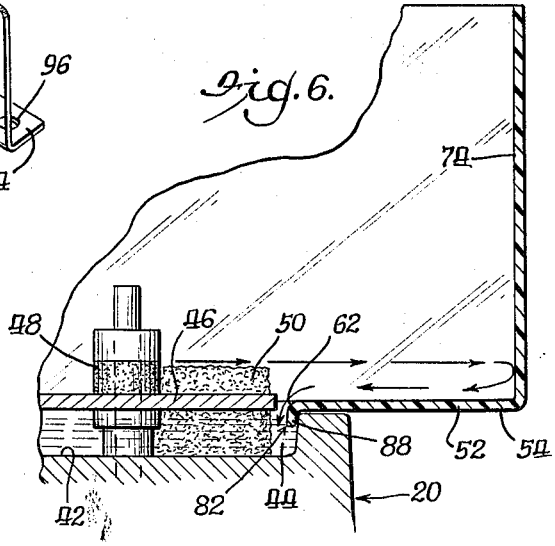
Fig. 6.
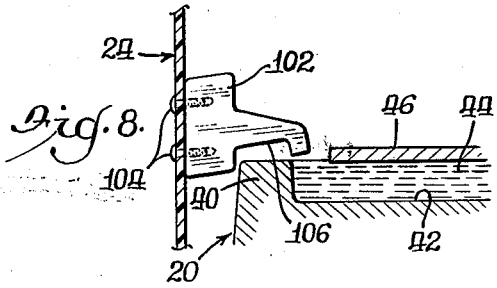
Fig. 8.
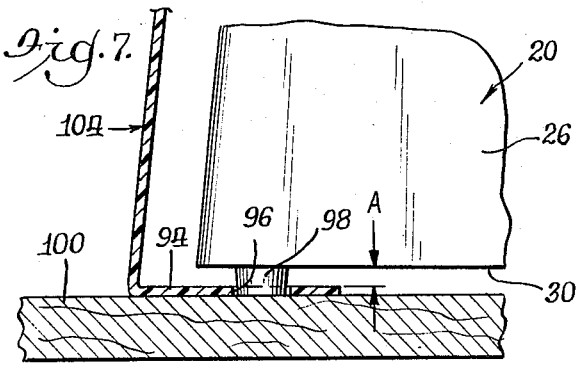
Fig. 7.
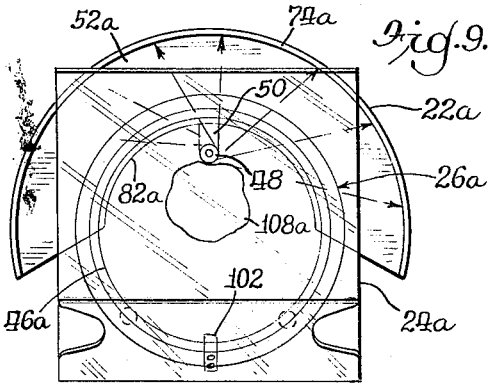
Fig. 9.

SPLASH SHIELD AND CUTTINGS GUARD FOR GLASS ROUTER

BACKGROUND OF THE INVENTION

This invention belongs generally to the field of glass routers and specifically to a splash shield and cuttings guard therefor.

Glass routers are used in creating stained glass artwork such as lampshades, decorative window panes and a variety of other art objects.

Stained glass artwork comprises different colored glass segments assembled in a predetermined overall pattern by lead separator strips cast or otherwise formed into place.

There are three basic, preliminary steps in creating such artwork: First, a pattern is designed. Second, the pattern is transferred to individual glass segments of the proper colors. Third, the appropriately colored glass segments are formed by using a glass cutter and breaking to approximately the correct sizes.

It is this third step with which the present invention is concerned. Glass segments rarely break exactly on the lines made by a glass cutter so all the edges must be finish ground with a glass router to have a perfect fit between pieces and to have a dull-roughened edge on which adhesive-backed copper foil can be applied in order to solder the glass segments together.

A typical glass router has a housing with top, bottom, front, back and side portions. The top portion has an upstanding abrasive grinding wheel and a work table for supporting a glass segment being ground on the wheel. Further, the top portion of the housing has a rim about the marign enclosing a reservoir for water which serves as a liquid coolant and lubricant.

The router wheel turns at a very high speed, typically 3,200 rpm and faster. This flings water and glass chips outwardly with considerable force. It is essential that some means be provided to prevent glass chips and water from flying into the eyes of operators and observers, their clothing, and the room in general.

Conventional protective gear comprises a small splash shield which protects an onlooker from some, but not all, flying glass particles and spray; and safety glasses or a face shield for the operator. No attempt has been made previously to recover the liquid coolant for reuse, or to protect an operator who does not wear safety glasses or a face shield.

Safety glasses and face shields are not entirely satisfactory for this service for several reasons: Safety glasses protect only the eyes and not the face, hair or body where glass can be embedded. Safety glasses are easily forgotten or misplaced. Safety glasses and face shields can be scratched so the operator removes them to see better. Also face shields are cumbersome and have to be removed or tilted upward to work with the glass segments after they are ground.

SUMMARY OF THE INVENTION

It is a general object of the present invention to provide a splash shield and cuttings guard for a glass router which protects both the operator and an observer from water spray and flying glass fragments.

Another object of the invention is to provide such a splash shield and cuttings guard which intercepts liquid coolant and cuttings flung off a grinding wheel and returns the coolant to a reservoir for reuse.

Another object is to provide such apparatus which is readily removable from the router for cleaning.

Another object is to provide a splash shield and cuttings guard apparatus which eliminates the need for the operator to wear safety glasses or a face shield.

Another object is to provide such apparatus in two separate, optionally usable components, one to serve the dual purpose of intercepting liquid coolant flung off the grinding wheel and returning it to the reservoir while simultaneously protecting an observer from spray and cuttings, and the other to protect the operator from spray and cuttings.

BRIEF DESCRIPTION OF THE DRAWINGS

Other objects and advantages of the invention will be apparent from the following description taken in connection with the accompanying drawings in which:

FIG. 1 is a left and front side perspective view of the apparatus;

FIG. 2 is a right and front side perspective view of the eye shield in the apparatus shown in FIG. 1;

FIG. 3 is a left and front perspective view of the side shield in the apparatus shown in FIGS. 1 and 2;

FIG. 4 is a top plan view of FIGS. 1 and 2;

FIG. 5 is an enlarged, fragmentary vertical cross sectional view of FIG. 4 taken on line 5—5;

FIG. 6 is an enlarged fragmentary vertical cross sectional view of FIG. 4 taken on line 6—6;

FIG. 7 is an enlarged fragmentary vertical cross sectional view of FIG. 4 taken on line 7—7;

FIG. 8 is a view similar to FIG. 5 showing an initial step in removing the eye shield; and FIG. 9 is a view similar to FIG. 4 of a modified form of the invention adapted to fit a different shaped router housing.

Like parts are referred to by like reference numerals.

DETAILED DESCRIPTION OF THE INVENTION

Referring now to the specific embodiments of the invention and the drawings, one form of a conventional glass router 20 is shown in FIG. 1. The splash shield and cuttings guard apparatus of the present invention is generally designated 21 and comprises two separate components, a side shield 22 and an eye shield 24.

The glass router 20 comprises a generally cubical housing 26 having top, bottom, front, back, and left and right side portions 28, 30, 32, 34, 36, and 38 respectively. The top portion has an upstanding rim 40 enclosing a reservoir 42 for water or other liquid coolant 44. A horizontal work table 46 is supported above the reservoir. An abrasive grinding wheel 48 extends above the work table and a sponge 50 serves as a wick, transferring water from the reservoir to the grinding wheel.

Although the splash shield and cuttings guard apparatus 21 is here illustrated as comprising two separate components 22 and 24, it will be apparent from the following description that these may be combined into one integral assembly if desired. Further, either component 22 or 24 can be used without the other if desired. A preferred material is a transparent plastic sheet such as polymerized methyl methacrylate ("Lucite") which has the desired optical clarity and thermoplastic forming properties.

The side shield 22 comprises a generally C-shaped base plate 52, in plan view, as best shown in FIGS. 2 and 3. The base plate outer margin 52 consists of left and right outer edges 56 and 58 respectively, and an outer back edge 60. The base plate inner margin 62 consists of left and right inner edges 64 and 66 respectively and an inner back edge 68. A pair of raised front edges 70, 72 extend radially with respect to the grinder wheel 48 as best shown in FIGS. 1 and 3. An upstanding wall 74, consisting of side panels 76 and 78 and a back panel 80 extends along the outer margin. A depending flange 82, consisting of side segments 84 and 86 and a back segment 88 are engageable with the inner edges of the side and rear portions of the housing rim 40 and extend downward, partly into the reservoir 42.

As best shown in FIG. 6, the base plate 52 is preferably slightly downwardly inclined from the outer margin 54 to the inner margin 62. This enables liquid and cuttings flung outwardly by the wheel 48 to be intercepted by the wall 74 and returned by gravity to the reservoir 42 via the base plate 52 and flange 82.

As best shown in FIGS. 1, 2 and 7, the eye shield 24 comprises a plate having an upstanding section 90 in front of the housing 26, a top section 92 inclined diagonally, rearwardly over the work table, and a rear flange 94 at the lower end extending backwardly beneath the bottom portion of the router housing. The flange has aperatures 96 through which the two front feet 98, 98 extend to directly engage a tabletop or other supporting base 100. About midway of the upstanding plate section 90, a clip 102 is fastened by screws 104. The clip has an underside recess 106, engageable with the housing rim 40 as best shown in FIG. 5. At least section 92 of the eye shield should be made of transparent material to enable an operator to manipulate and observe a workpiece 108 through it.

As best shown in FIGS. 1 and 4, the side shield 22 and eye shield 24 are spaced apart at the front of the housing by spaces s,s through which an operator's arms 110, 110 may be inserted to manipulate the workpiece 108. At the same time, the operator's eyes and clothing are fully protected by the eye shield from sprayed liquid and cuttings, and an observer is protected by the side shield which also serves the dual function of returning liquid coolant to the reservoir for reuse as described.

As shown in FIGS. 5 and 7, the eye shield 24 is dimensioned so that, when the clip 102 is assembled on the rim 40, and the bottom flange 94 rests on the support 100, a space A exists between the flange 94 and the housing bottom 30. As shown in FIG. 5, the clip 102 vertically overlaps the rim 40 by a distance B. The eye shield is made with dimension A greater than dimension B enabling it to be removed simply by lifting the eye shield and tilting it outwardly to disengage the clip from the rim as shown in FIG. 8, followed by lifting the router housing to disengage feet 98 from the openings 96.

FIG. 9 shows a modified form of the invention, similar to the embodiment shown in FIGS. 1–8, applied to a glass router having a circular cross section housing 26A and circular worktable 46A. The side shield **22*a* comprises a C-shaped base plate 52*a* having an upstanding arcuate wall 74*a* and a depending arcuate flange 82*a*. The eye shield 24*a* is substantially the same as eye shield 24 with minor dimensional modifications to fit the circular housing 26*a***.

The embodiments described to illustrate the present invention have been necessarily specific for purposes of illustration. Alterations, extensions, and modifications would be apparent to those skilled in the art.

The embodiments of the invention in which an exclusive property or privilege is claimed are defined as follows:

1. In combination, a glass router and improved splash shield and cuttings guard in which:

said router comprises a housing having top, bottom, front, back and side portions; the top portion having a rim enclosing a reservoir for liquid coolant, a horizontal work table above the reservoir and an abrasive router wheel positioned to grind a workpiece on the table; the bottom portion having foot means at least along the front edge;

said splash shield and cuttings guard comprising a readily removable side shield and a readily removable eye shield;

said side shield comprising a generally C-shaped horizontal base plate having outer and inner margins, an upstanding wall extending along the outer margin at the back and sides of the housing to intercept coolant and cuttings flung outwardly by said wheel, a depending flange extending along the inner margin, engaged with the inner edge of the rim at the back and sides of the housing, and extending into the reservoir; and said eye shield comprising a plate having an upstanding section in front of the housing, a transparent section at the top of the upstanding section inclined diagonally rearwardly for viewing a workpiece on the work table, a rearwardly extending flange at the lower end of the upstanding section extending beneath the bottom portion of the housing, said flange having apertures through which said foot means extends to engage a supporting base, said eye shield plate having a clip on the back side thereof being engaged with the rim at the front of the housing to thereby retain said eye shield in an upright working position;

whereby coolant and cuttings flung outwardly by the wheel are intercepted by said wall and coolant is recycled to the reservoir via the base plate and flange; and whereby further said side shield is readily removable by upward movement to disengage the flange of the side shield from the rim; and said eye shield is readily removable by upward movement to disengage the clip from the rim followed by downward movement to disengage the foot means from the apertures in the flange of the eye shield.

2. In combination, a glass router and improved splash shield and cuttings guard according to claim 1 in which said upstanding wall on the side shield is at substantially the same level as the upper portion of said vertical section of the eye shield, and the forward margins of the wall are set back from said vertical section to provide spaces on both sides of the eye shield through which an operator's arms may extend for manipulating a workpiece on the work table while viewing the operation through the transparent section of the eye shield.

3. In combination, a glass router and improved splash shield and cuttings guard according to claim 2 in which recesses are provided in the sides of said upstanding section of said eye shield at the level of said wall of said side shield to enlarge said spaces and facilitate extending an operator's arms therethrough.

4. In a glass router, an improved splash and cuttings guard according to claim 2 in which the base plate has a pair of raised front margins on opposite sides of the housing to block forward spillage of coolant from the base plate.

5. In a glass router with a housing having top, bottom, front, back and side portions; the top portion having a rim and enclosing a reservoir for liquid coolant, a horizontal work table above the reservoir and an abrasive router wheel positioned to grind a workpiece on the table; the bottom portion having foot means along at least the front edge;

an improved splash and cuttings guard comprising a readily removable eye shield consisting of a plate having an upstanding section adapted to be placed in front of the housing, a transparent section at the top of the vertical section inclined diagonally rearwardly for viewing a workpiece on the work table, a rearwardly extending flange at the lower end of said upstanding section extendible beneath the bottom portion of the housing, said flange having apertures adapted to receive and interlock with said foot means when the latter engages a supporting base, said plate having a clip on the back side thereof which is engageable with the rim at the front of the housing to thereby retain said eye shield in an upright working position;

whereby said eye shield is readily removable by upward movement to disengage the clip from the rim followed by downward movement to disengage the foot means from the apertures in the flange.

* * * * *